US006019580A

United States Patent [19]

Barr et al.

[11] Patent Number: 6,019,580

[45] Date of Patent: Feb. 1, 2000

[54] TURBINE BLADE ATTACHMENT STRESS REDUCTION RINGS

[75] Inventors: Lawrence D. Barr, Tempe; Frederick G. Borns, Chandler; Mark C. Johnson, Phoenix, all of Ariz.

[73] Assignee: AlliedSignal Inc., Morris Township, N.J.

[21] Appl. No.: 09/028,146

[22] Filed: Feb. 23, 1998

[51] Int. Cl.[7] ..... B63H 1/16

[52] U.S. Cl. ..... 416/219 R; 415/170.1; 415/173.7; 416/193 A; 416/239; 416/248; 416/220 R; 416/241 R

[58] Field of Search ..... 415/115, 170.1, 415/173.7; 416/193 A, 219 R, 239, 248, 220 R, 241 R

[56] References Cited

U.S. PATENT DOCUMENTS

| | | | |
|---|---|---|---|
| 3,458,119 | 7/1969 | Shaw . | |
| 3,824,030 | 7/1974 | DeFeo | 415/136 |
| 4,088,421 | 5/1978 | Hoeft | 416/193 A |
| 4,453,890 | 6/1984 | Brantley . | |
| 4,685,863 | 8/1987 | McLean | 416/95 |
| 4,854,821 | 8/1989 | Kernon et al. | 416/95 |
| 5,435,694 | 7/1995 | Kray et al. . | |
| 5,478,207 | 12/1995 | Stec | 416/219 R |
| 5,498,139 | 3/1996 | Williams | 415/173.7 |
| 5,620,308 | 4/1997 | Yoshinari et al. . | |

*Primary Examiner*—Edward K. Look
*Assistant Examiner*—Matthew T. Shanley
*Attorney, Agent, or Firm*—Robert Desmond, Esq.

[57] ABSTRACT

A turbine or compressor disk assembly comprises a plurality of blades attached to a central hub by means of the blade root of each blade engaging a corresponding slot in the hub. According to the principles of the present invention, a turbine or compressor disk assembly includes one or more locally bulging regions extending axially away from the surface of the disk in the vicinity of the bottom contact plane of the disk attachment firtree. The locally bulging regions reduce the peak Macke stress in the disk bottom fillet and blade attachment root. In an illustrative embodiment, two locally bulging regions are incorporated into the disk and the corresponding blades, one of which extends forward from the leading edge of the disk and the other of which extends rearward from the trailing edge of the disk. The rearward locally bulging region has an exaggerated extension which allows the stress reduction ring to form an aft flow discouragger as well as functioning to reduce peak stress.

34 Claims, 4 Drawing Sheets

FIG. 4
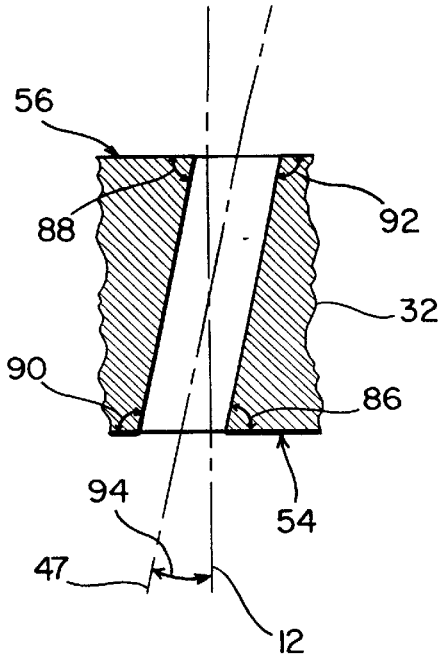
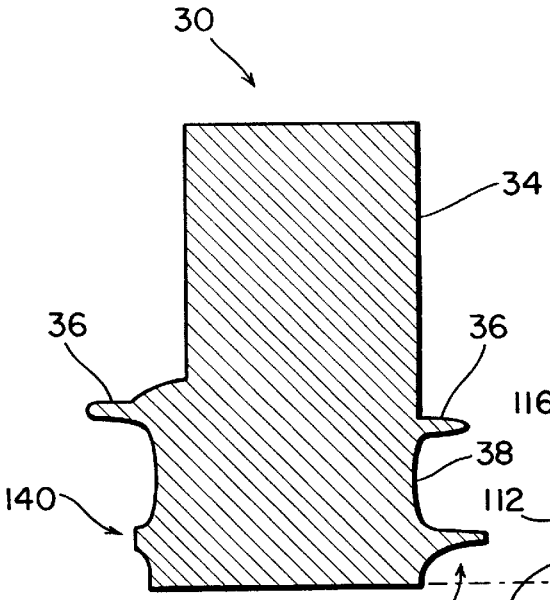
FIG. 6
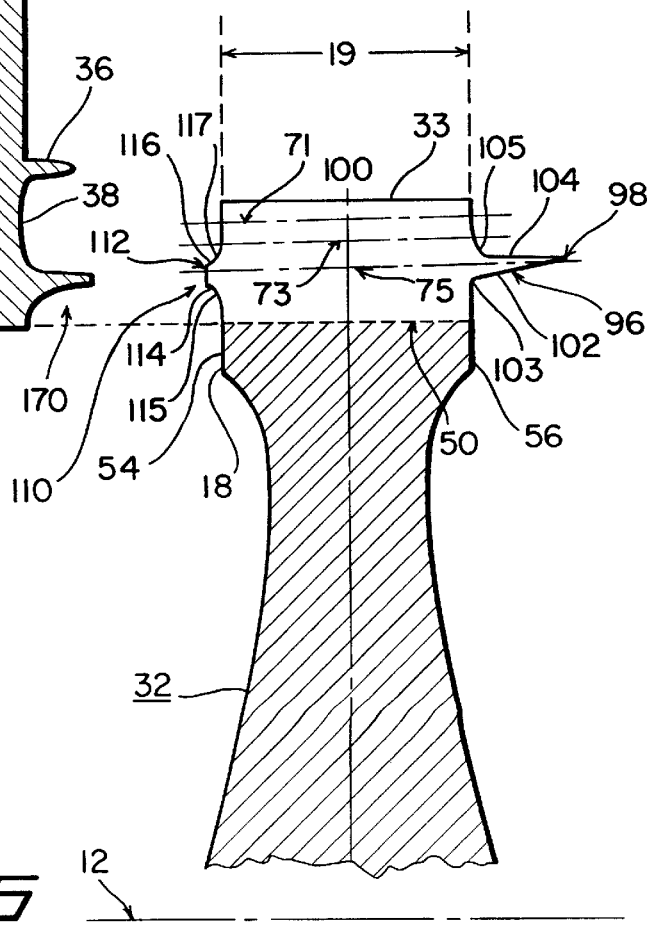
FIG. 5

TURBINE BLADE ATTACHMENT STRESS REDUCTION RINGS

FIELD OF THE INVENTION

The present invention relates to turbomachinery in general and to a turbine or compressor assembly in which individual compressor or turbine blades are attached to a hub, in particular.

BACKGROUND OF THE INVENTION

A typical turbine rotor assembly of a gas turbine engine has a plurality of turbine blades or airfoils extending radially outward from a central disk across a fluid path. Turbine blades generally comprise a unitary casting consisting of an airfoil section formed radially outward of a platform, which is formed radially outward of a blade root section. The blade is mounted to the disk by sliding the root portion of the blade into a mating slot cut in the disk. High pressure, high temperature combustion products from the combustion section flow past the plurality of airfoils, which in turn, convert a portion of the thermodynamic energy in the fluid into mechanical energy in the form of a torque about the engine shaft, which causes the shaft to turn at a high rate of speed.

The high rotational speeds typical in a modem gas turbine engine produce high centripetal acceleration and correspondingly high stresses in the turbine disk and blade root. Because the major stress component is acceleration induced, simply adding additional material in high stress areas often does not result in an improved design, since the additional material also adds additional mass to the rotating system. Accordingly, what is needed is a feature in the blade and disk that minimizes peak stress without adding significant mass to the rotating system.

SUMMARY OF THE INVENTION

According to the principles of the present invention, a turbine or compressor disk assembly includes one or more locally bulging regions extending axially away from the surface of the disk in the vicinity of the bottom contact plane of the disk attachment firtree. The locally bulging regions are positioned so as to reduce peak Macke stress in the disk bottom fillet and blade attachment root, without adding significant mass to the rotating system.

In one embodiment of the invention, two locally bulging regions are incorporated into the disk. One region extends forward from the leading edge of the disk and the other region extends rearward from the trailing edge of the disk. These locally bulging regions form, in effect, stress reduction rings superimposed on the front and rear surfaces of the turbine disk. Corresponding locally bulging regions are preferably incorporated into the blade root to form a substantially continuous surface extending between the locally bulging regions extending from the disk. The rearward locally bulging region may have an exaggerated extension which allows the stress reduction ring to form an aft flow discourager as well as functioning to reduce peak stress.

BRIEF DESCRIPTION OF THE DRAWING

The invention will be better understood from a reading of the following detailed description taken in conjunction with the drawing figures in which like reference designators are used to designate like elements, and in which:

FIG. 4 is a partial cross sectional view of the turbine disk of FIG. 3 taken along line 4—4;

FIG. 5 is a cross sectional view of a portion of a turbine disk incorporating features of the present invention; and FIG. 6 is a cross sectional view of a turbine blade incorporating features of the present invention.

DETAILED DESCRIPTION

Figure 1:
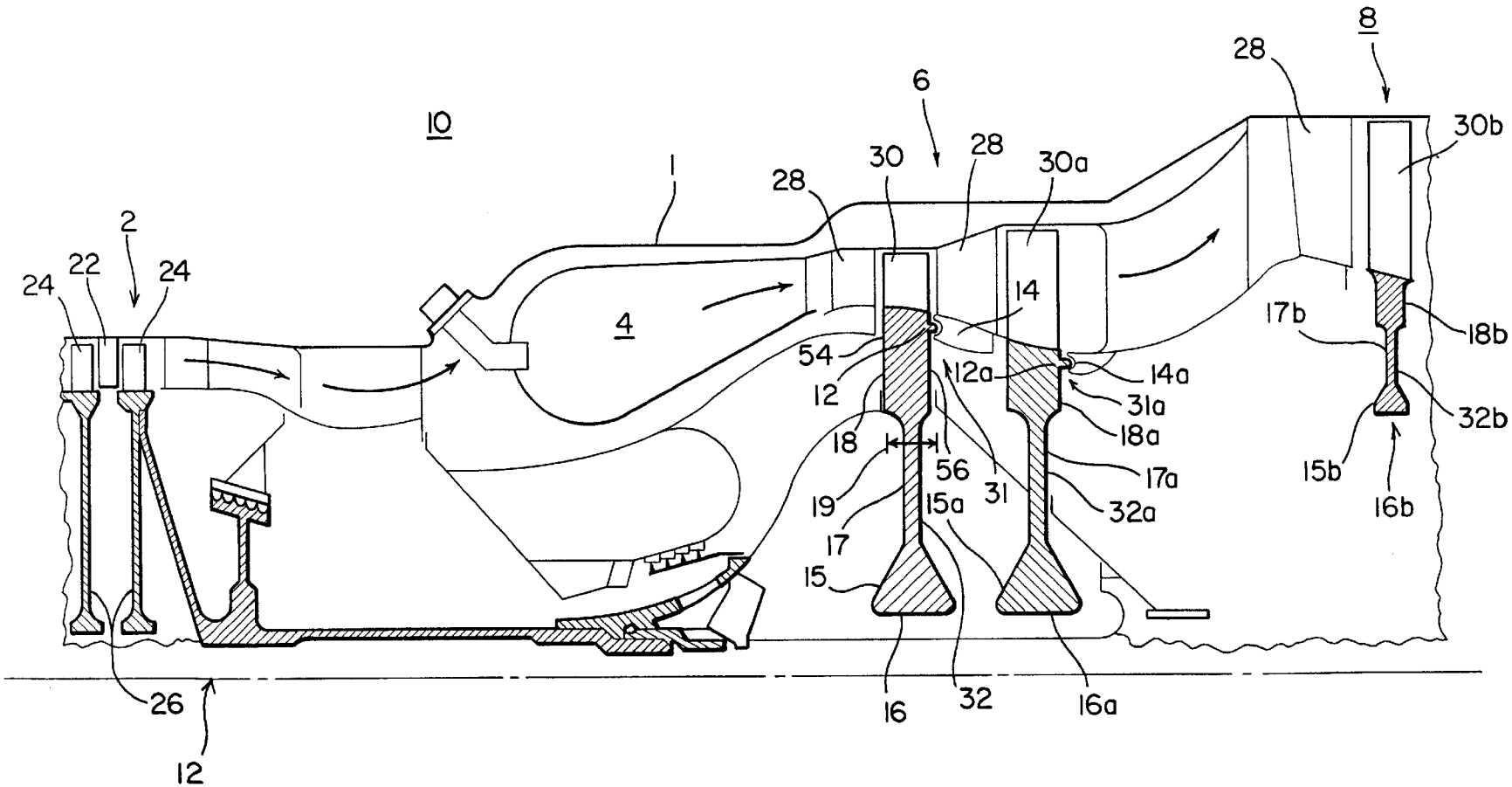
FIG. 1 is a cross sectional view of a portion of a gas turbine engine having a compressor section and a turbine section.

The drawing figures are intended to illustrate the general manner of construction and are not to scale. In the description and in the claims the terms left, right, front and back and the like are used for descriptive purposes. However, it is understood that the embodiment of the invention described herein is capable of operation in other orientations than is shown and the terms so used are only for the purpose of describing relative positions and are interchangeable under appropriate circumstances.

FIG. 1 is a partial upper-half axi-symmetric cross-section of a portion of a typical gas turbine engine 10 disposed about a centerline axis 11. Engine 10 includes a housing 1 containing in serial flow relationship, a compressor section 2, a combuster 4, a high pressure turbine section 6 and a low pressure turbine section 8. Compressor section 2 comprises one or more sets of circumferentially disposed compressor vanes 22 and one or more sets of circumferentially disposed compressor blades 24 each attached to a respective compressor disk 26. Similarly turbine sections 6 and 8 comprise one or more sets of circumferentially disposed turbine vanes 28 and one or more sets of circumferentially disposed turbine blades 30, 30*a*, 30*b* each attached to a respective turbine disk 32, 32*a*, 32*b*. Each of turbine disks 32, 32*a* and 32*b* include a hub 15, 15*a*, 15*b*, having an axial bore 16, 16*a*, 16*b* therethrough, a web section 17, 17*a*, 17*b* extending radially outward from hub 15, 15*a*, 15*b* respectively, and a rim section 18, 18*a*, 18*b* extending radially outward from rim sections 17, 17*a*, 17*b* respectively. Rim section 18 has an axial thickness 19 defined by front face 54 and rear face 56. The leading and trailing edges of at least high pressure turbine blades 30, 30*a* may include a flow discourager 31, 31*a* comprising a projection 12, 12*a* extending from the trailing edge of the turbine blades and disk. Projections 12, 12*a* form a labyrinth seal in cooperation with similar stationary projections 14, 14*a* within engine housing 1.

Figure 2:
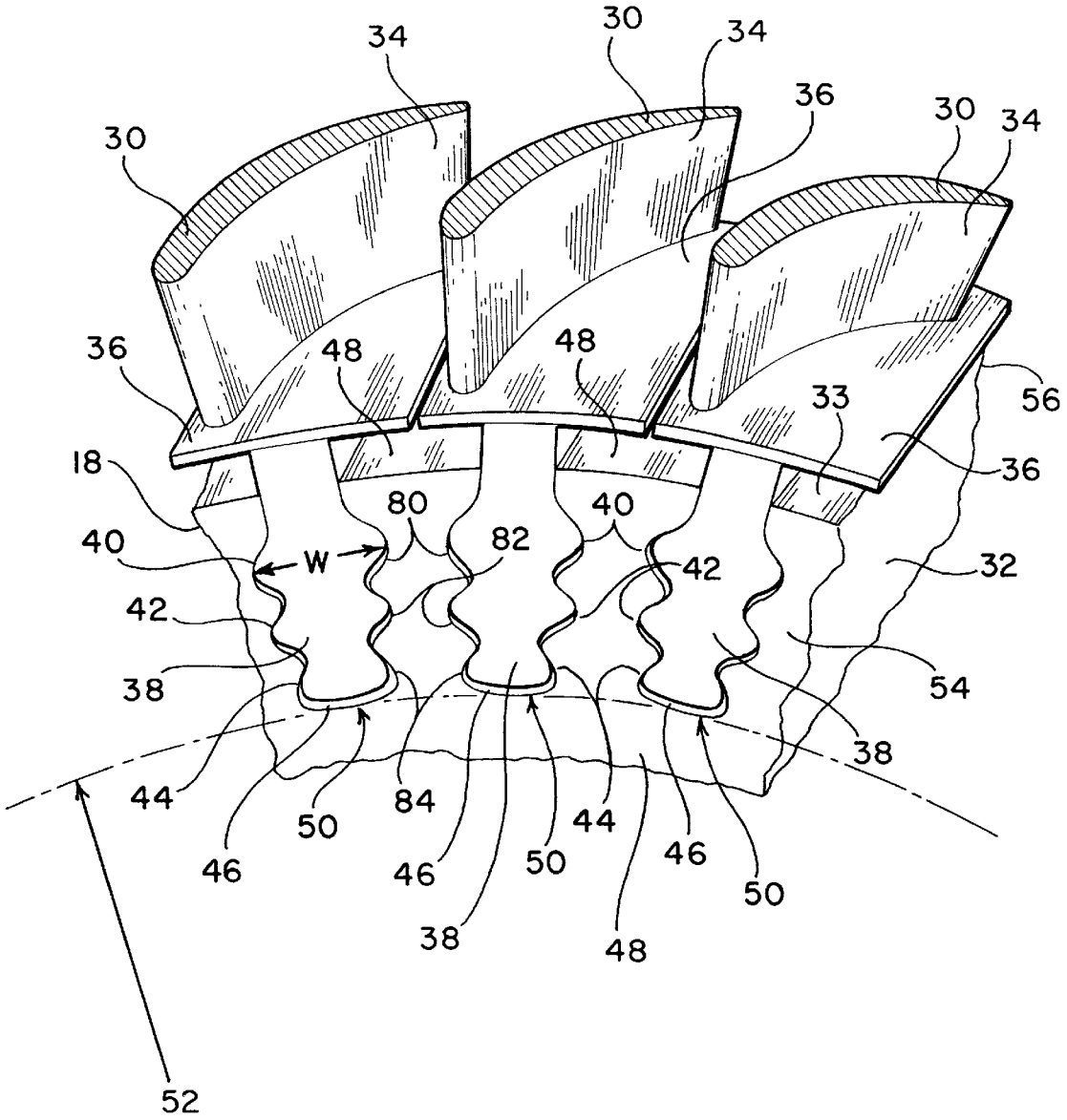
FIG. 2 is a perspective view of a section of a turbine blade and disk assembly.

As shown more clearly in FIG. 2, each of turbine blades 30 comprises an airfoil section 34, a platform 36, and a root 38. Each root section 38 is typically formed into a series of lobes 40, 42, 44 having decreasing circumferential width (w) moving from the radially outwardmost lobe 40, known as the "top lobe," to the radially inwardmost lobe 44, known as the "bottom lobe," with the radially central lobe 42, known as the "mid lobe" disposed therebetween having an intermediate lobe width. Multi-lobed airfoil root 38 is often referred to as a firtree, because of this characteristic shape. Root 38 of blade 30 engages a substantially axial slot 46 machined in the radial face 33 of rim section 18 of turbine disk 32 extending from the front face 54 to the back face 56 of turbine disk 32. The axial slot 46 comprises a series of fillets 80, 82, 84, which substantially conform to the firtree shape of root 38 so as to retain blade 30 under the high temperature, high stress environment of the rotating turbine. By forming a plurality of slots 46 in disk 32, a plurality of blade attachment posts 48 are formed as a consequence. As can be determined from inspection of FIG. 2, only that portion of turbine disk 32 radially inward of the radially inwardmost points 50 of slots 46 contributes significantly to the circumferential strength of turbine disk 32. Accordingly, the locus of these inwardmost points 50 is often referred to as the live rim radius 52.

Figure 3:
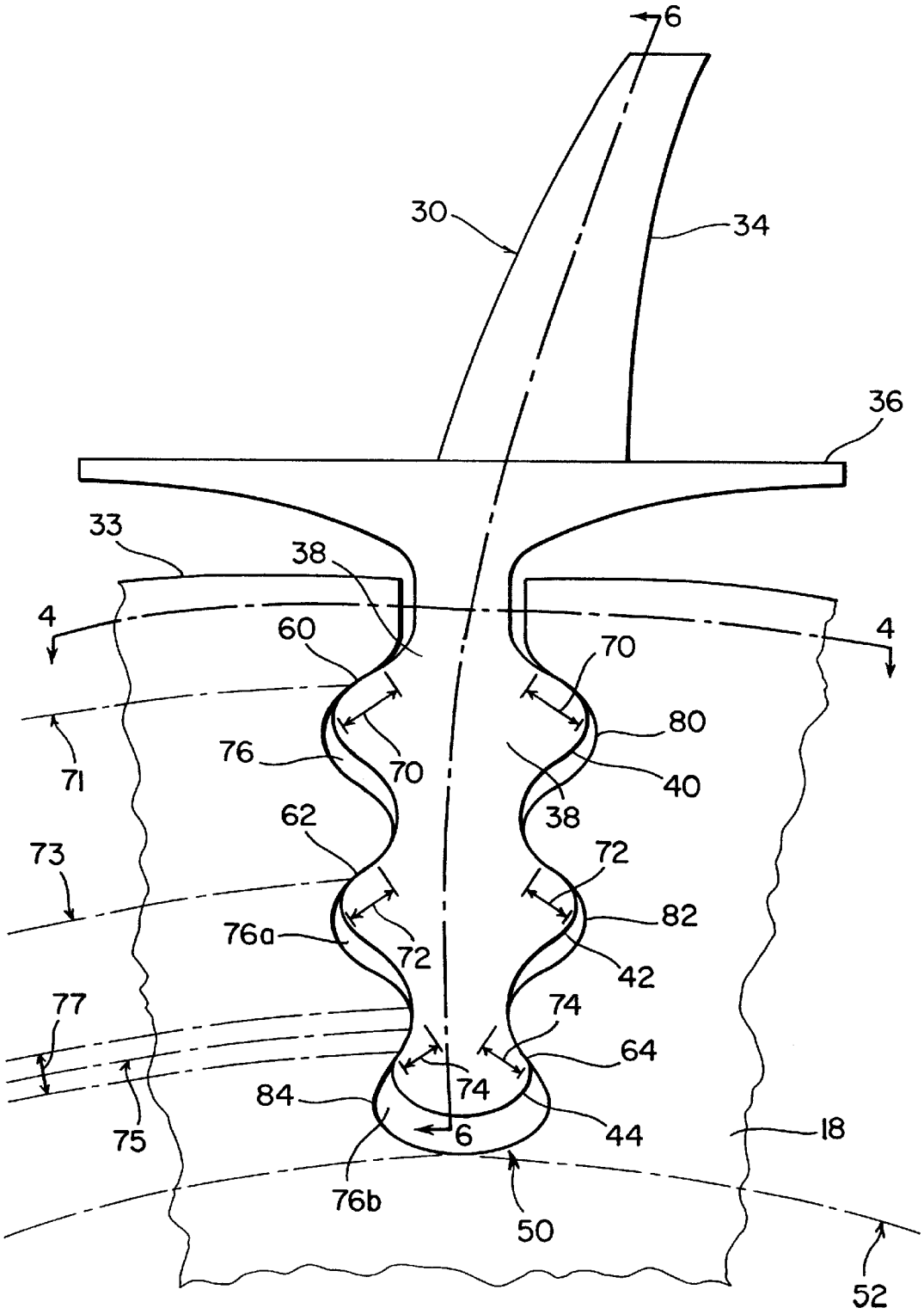
FIG. 3 is an end view of a single blade and a corresponding portion of a turbine disk.

During operation of engine 10, the centripetal acceleration acting on the blade 30 causes the blade root 38 to engage slot 46 along well defined contact zones, as shown in FIG. 3. Top lobe 40 of root 38 engages top lobe 60 of disk 32 along top contact zones 70. Bottom lobe 44 of root 38 engages bottom lobe 64 of disk 32 along bottom contact zones 74, and mid lobe 42 of root 38 engages mid lobe 62 of disk 32 along mid contact zones 72. The center of top contact zone 70 is hereinafter referred to the top contact plane 71. Similarly, the center of mid contact zone 72 is hereinafter referred to the mid contact plane 73 and the center of bottom contact zone 74 is hereinafter referred to the bottom contact plane 75. The superposition of bottom contact zone 74 onto a radial plane is referred to herein as the bottom contact plane radial height 77. The unresolved radial/circumferential length of engagement of each of contact zones 70, 72, 74 is hereinafter referred to as the contact length.

Non contact clearances between top blade lobe 40 and top disk fillet 80; mid blade lobe 42 and mid disk fillet 82; and bottom blade lobe 44 and bottom disk fillet 84 are indicated generally at 76, 76*a* and 76*b*. Non contact clearances 76, 76*a*, 76*b* allow assembly of the blade to the disk and allow for thermal expansion and contraction of the blade/disk assembly in use.

With reference to FIG. 4, typically, the centerline of slot 46 is not perpendicular to the front and back surfaces of disk 32, but instead has a circumferential pitch, such that the centerline 47 of the slot 46 is in a direction between perpendicular and a line parallel to the chord of the airfoil comprising blade 34. Accordingly, instead of making four right angles with the front surface 54 and back surface 56 of disk 32, slot 46 makes two acute angles 86, 88 and two obtuse angles 90, 92 with front and rear surfaces 54 and 56. The combination of the pressure and centrifugal loading on turbine blades causes the peak stresses in slot 46 to occur in the region of the bottom fillet 84 at the acute corners 86 and 88 near the pressure side leading edge and the suction side trailing edge. This peaking phenomenon is primarily a function of the root lobe design, blade cooling, slot circumferential pitch angle 94 and is well known as the "Macke" effect.

FIG. 5 is a an axi-symmetric cross section of a portion of a turbine disk 32 incorporating features of the present invention, and FIG. 6 is a cross-sectional view of a turbine blade 30 incorporating features of the present invention. While engaging in efforts to minimize the deleterious effects of suspending an aft flow discourager from a turbine blade and disk, the inventors of the present invention discovered that, surprisingly, if the flow discourager was positioned to coincide with the bottom lobe contact zone the discourager did not have a deleterious effect at all. Instead, the opposite was true. The aft flow discourager actually reduced the Macke stress at the trailing edge of the blade and disk. It was further discovered that similar stress reductions could be achieved at the leading edge if a ring of additional material were positioned along the leading edge of the blade and disk also to coincide with the bottom lobe contact plane.

As shown in FIG. 5, a turbine disk 32 incorporating features of the present invention comprises a locally bulging region 96 extending axially rearward to form a ringlike structure about centerline axis 11. The area centroid of the half cross-section of locally bulging region 96 is proximal to, and preferably centered about, the bottom contact plane 75. In the illustrative embodiment of FIG. 4, the maximum axial excursion of locally bulging region 96 from the rear surface 56 of disk 32 is approximately 0.335 inches for a disk having an approximately 6 inch radius. Locally bulging region 96 tapers axially inward toward centerline 100 from its maximum axial excursion 98 moving radially inward along surface 102 with an appropriate fillet radius 103. Locally bulging region 96 also tapers axially inward moving radially outward along surface 104 with an appropriate fillet radius 105. In the embodiment of FIG. 4, fillet radii 103, 105 are approximately 0.40 inch.

The locally bulging region 96 may have a flat or a rounded tip, but in all cases, the radially inward taper surface 102 begins radially outward of the live rim radius 52 moving from the maximum axial excursion radially inward. Preferably, the radially inward taper surface 102 begins no further radially inward than one or two times the bottom contact height 74 inward of the bottom contact plane 75; and most preferably, the radially inward taper 102 begins no further radially inward than one half of one contact height 77 radially inward of the bottom contact plane 75.

Similarly, except in the case of a single lobe firtree, discussed hereinafter, the radially outward taper 104 begins radially inward of the top contact plane 71 moving from the maximum axial excursion radially outward. Preferably, the radially outward taper 104 begins at a point no further radially outward than mid contact plane 73, which is the contact plane immediately radially outward of the bottom contact plane 75.

Although a three-lobed firtree is shown in the illustrative embodiment, firtrees of fewer than three or more than three lobes are contemplated within the scope of the present invention. In the case of a single lobe attachment, top contact plane 71 coincides with bottom contact plane 75. Accordingly, for a single lobe attachment, the radially outward taper 104 begins at a point no further radially outward than twice the contact height 77 radially outward of the bottom (i.e. only) contact plane 75.

In all cases the radially outward taper 104 preferably begins at a point no further radially outward than one or two times the contact height 77 radially outward of the bottom contact plane 75, and most preferably no more than one half of one contact height 77 radially outward of the bottom contact plane 75.

Also as shown in FIG. 5, a turbine disk 32 incorporating features of the present invention further includes a second locally bulging region 110 extending axially forward to form a second ringlike structure disposed about centerline axis 11. The area centroid of the half cross-section of locally bulging region 110 is also proximal to, and preferably centered about, the bottom contact plane 75. In the illustrative embodiment of FIG. 5, the maximum axial excursion 112 of second locally bulging region 110 from the front surface 54 of disk 32 is approximately 0.09 inches and the radial flattened section is approximately 0.07 inches for a disk having an approximately 6 inch radius. Second bulging region 110 tapers axially inward (i.e. toward centerline 100) from its maximum axial excursion 112 moving radially inward along surface 114 with an appropriate fillet radius 115. Second bulging region 110 also tapers axially inward moving radially outward along surface 116. Second bulging region 110 may have a flat tip as shown in FIG. 5, or may have a rounded tip, but in all cases, the radially inward taper 114 begins radially outward of the live rim radius 52 moving from the maximum axial excursion radially inward.

Preferably, radially inward taper 114 begins no further radially inward than one or two times the bottom contact height 77 inward of the bottom contact plane 75; and most preferably, radially inward taper 114 begins no further radially inward than one half of one contact height 77 radially inward of the bottom contact plane 75.

Similarly, except in the case of a single lobe firtree, discussed hereinafter, the radially outward taper 116 begins radially inward of the top contact plane 71 moving radially outward from maximum axial excursion 112. Preferably, radially outward taper 116 begins at a point no further radially outward than mid contact plane 75, which is the contact plane immediately radially outward of bottom contact plane 75. Taper 116 also includes an appropriate fillet radius 117. In the embodiment of FIG. 4, fillet radii 115 and 117 are approximately 0.45 inch.

As discussed above, although a three-lobed firtree is shown in the illustrative embodiment, firtrees of fewer than three or more than three lobes are contemplated within the scope of the present invention. In the case of a single lobe attachment, top contact plane 71 coincides with bottom contact plane 75. Accordingly, for a single lobe attachment, the radially outward taper 116 begins at a point no further radially outward than twice the contact height 77 radially outward of the bottom (i.e. only) contact plane 75.

In all cases, more preferably, the radially outward taper 116 begins at a point no further radially outward than one or two times the contact height 77 radially outward of the bottom contact plane 75, and most preferably no more than one half of one contact height 77 radially outward of the bottom contact plane 75.

The rearward locally bulging region 96 may be extended as shown in FIG. 1 to form a projection 12 forming part of an aft flow discourager 31, which in combination with one or more similar projections from the engine housing 14, create a surface that tends to prevent flow of hot gases in the flow path from mixing with cooling air flow behind the turbine disk. Alternatively, where no aft-side flow discourager is required, the form of locally bulging region 96 will more nearly mirror that of the forward locally bulging region 110. Alternatively, where a leading edge flow discourager is required, the forward second locally bulging region 110 may be extended to more nearly mirror that of the aft-side flow discourager region 96.

As shown in FIG. 6, optimally, a plurality of turbine blades 30 are formed with third and fourth locally bulging regions 120 and 140 respectively in blade root 38 such that when blade 30 is installed in disk 32, the surface of locally bulging region 120 substantially coincides with the surface of locally bulging region 96 and the surface of locally bulging region 140 substantially coincides with locally bulging region 110 such that the blade/disk combination presents a substantially continuous surface radially inward of the outer periphery 33 having the cross section of FIG. 4. The extension of the locally bulging regions to include the blade root 38 provides additional surface area for reaction of the Macke stress, thereby further reducing the local peak stress.

Although the invention has been described in terms of the illustrative embodiment, it will be appreciated by those skilled in the art that various changes and modifications may be made to the illustrative embodiment without departing from the spirit or scope of the invention. It is intended that the scope of the invention not be limited in any way to the illustrative embodiment shown and described but that the invention be limited only by the claims appended hereto.

What is claimed is:

1. A gas turbine engine comprising:

a turbine disk comprising a hub having an axial bore, a web extending radially from said hub and terminating in a rim section extending radially outward from said web, said rim section including first and second radial faces defining a first axial thickness;

said rim section including a plurality of slots passing substantially axially from said first radial face to said second radial face defining a live rim radius of said disk, said slots each defining at least one disk fillet adapted to engage a corresponding blade lobe along a contact zone centered about a contact plane, for retaining a turbine blade to said disk;

said rim section further including a first bulging region integral to and extending axially outward from said first radial face, said first bulging region having a maximum axial excursion proximal said contact plane; and a first inward taper, said first inward taper comprising a region tapering axially inward with decreasing radial dimension from said maximum axial excursion, said first inward taper beginning at a point radially outward of said live rim radius.

2. The gas turbine engine of claim 1, wherein:

said contact zone extends radially over a contact height centered about said contact plane; and said first inward taper begins at a point no more than one said contact height radially inward of said contact plane.

3. The gas turbine engine of claim 1, wherein:

said contact zone extends radially over a contact height centered about said contact plane; and said first inward taper begins at a point no more than one half of one said contact height radially inward of said contact plane.

4. The gas turbine engine of claim 1, wherein:

said contact zone extends radially over a contact height centered about said contact plane; and said first locally bulging region further comprises a second inward taper, said second inward taper comprising a region tapering axially inward with increasing radial dimension from said maximum axial excursion, said second inward taper beginning at a point no more than two said contact heights radially outward of said contact plane.

5. The gas turbine engine of claim 4, wherein:

said second inward taper begins at a point no more than one said contact height radially outward of said contact plane.

6. The gas turbine engine of claim 4, wherein:

said second inward taper begins at a point no more than one half of one said contact height radially outward of said contact plane.

7. The gas turbine engine of claim 1, further comprising:

a second bulging region integral to and extending axially outward from said second radial face, said second bulging region having a second maximum axial excursion proximal said contact plane.

8. The gas turbine engine of claim 4, further comprising:

a second bulging region integral to and extending axially outward from said second radial face, said second bulging region having a second maximum axial excursion proximal said contact plane.

9. The gas turbine engine of claim 8, further comprising:

a third inward taper, said third inward taper comprising a region tapering axially inward with decreasing radial dimension from said second maximum axial excursion, said third inward taper beginning at a point radially outward of said live rim radius.

10. The gas turbine engine of claim 9, wherein:

said third inward taper begins at a point no more than one said contact height radially inward of said contact plane.

11. The gas turbine engine of claim 9, wherein:

said third inward taper begins at a point no more than one half of one said contact height radially inward of said contact plane.

12. The gas turbine engine of claim 9, further comprising:

a fourth inward taper, said fourth inward taper comprising a region tapering axially inward with increasing radial dimension from said second maximum axial excursion, said fourth inward taper beginning at a point no more than two said contact heights radially outward of said contact plane.

13. The gas turbine engine of claim 12, wherein:

said fourth inward taper begins at a point no more than one said contact height radially outward of said contact plane.

14. A gas turbine engine comprising:

a turbine disk comprising a hub having an axial bore, a web extending radially from said hub and terminating in a rim section extending radially outward from said web, said rim section including first and second radial faces defining a first axial thickness;

said rim section including a plurality of slots passing substantially axially from said first radial face to said second radial face defining a live rim radius of said disk, said slots each defining at least one disk fillet adapted to engage a corresponding blade lobe along a contact zone centered about a contact plane, for retaining a turbine blade to said disk;

said rim section further including a first bulging region integral to and extending axially outward from said first radial face, said first bulging region having a maximum axial excursion proximal said contact plane;

a second bulging region integral to and extending axially outward from said second radial face, said second bulging region having a second maximum axial excursion proximal said contact plane; and a plurality of blades adapted to be disposed into an installed position in said plurality of slots, each of said plurality of blades including a blade shank having a third bulging region having a position with a radius with respect to a central axis and an angle with respect to a reference line that are the same as a radius with respect to a central axis and an angle with respect to a reference line of said first bulging region and a fourth bulging region having a position with a radius with respect to the central axis and an angle with respect to the reference line that are the same as a radius with respect to the central axis and an angle with respect to the reference line of said second bulging region in said installed position.

15. A gas turbine engine comprising:

a turbine disk comprising a hub having an axial bore, a web extending radially from said hub and terminating in a rim section extending radially outward from said web, said rim section including first and second radial faces defining a first axial thickness;

said rim section including a plurality of slots passing substantially axially from said first radial face to said second radial face defining a live rim radius of said disk, said slots each defining at least one disk fillet adapted to engage a corresponding blade lobe along a contact zone centered about a contact plane, for retaining a turbine blade to said disk;

said rim section further including a first bulging region integral to and extending axially outward from said first radial face, said first bulging region having a maximum axial excursion proximal said contact plane; and a plurality of blades adapted to be disposed into an installed position in said plurality of slots, each of said plurality of blades including a blade shank having a third bulging region having a position with a radius with respect to a central axis and an angle with respect to a reference line that are the same as a radius with respect to a central axis and an angle with respect to a reference line of said first bulging region in said installed position.

16. A gas turbine engine comprising:

a turbine disk comprising a hub having an axial bore, a web extending radially from said hub and terminating in a rim section extending radially outward from said web, said rim section having first and second radial faces defining a first axial thickness;

said rim section including a plurality of slots passing substantially axially from said first radial face to said second radial face defining a live rim radius of said disk, each of said plurality of slots defining a plurality of disk fillets adapted to engage a corresponding plurality of blade lobes along a corresponding plurality of contact zones, for retaining a plurality of turbine blades to said disk, each of said plurality of contact zones being centered about a corresponding plurality of concentric contact planes;

said rim section further including a first bulging region integral to and extending axially outward from said first radial face, said first bulging region having a maximum axial excursion proximal to the radially inwardmost of said plurality of concentric contact planes; and a first inward taper, said first inward taper comprising a region tapering axially inward with decreasing radial dimension from said maximum axial excursion, said first inward taper beginning at a point radially outward of said live rim radius.

17. The gas turbine engine of claim 16, wherein:

the radially inwardmost of said plurality of contact zones extends radially over an average contact height centered about the radially inwardmost of said contact planes; and said first inward taper begins at a point no more than one said average contact height radially inward of the radially inwardmost of said plurality of concentric contact planes.

18. The gas turbine engine of claim 16, wherein:

said first inward taper begins at a point no more than one half of one said average contact height radially inward of the radially inwardmost of said plurality of concentric contact planes.

19. The gas turbine engine of claim 16, further comprising:

a second inward taper, said second inward taper comprising a region tapering axially inward with increasing radial dimension from said maximum axial excursion, said second inward taper beginning at a point radially inward of the radially outwardmost of said plurality of concentric contact planes.

20. The gas turbine engine of claim 19, wherein:

one of said plurality of concentric contact planes is immediately radially outward of the radially inwardmost of said plurality of concentric contact planes; and said second inward taper begins at a point radially inward of said one of said plurality of concentric contact planes.

21. The gas turbine engine of claim 19, wherein:

the radially inwardmost of said plurality of contact zones extends radially over an average contact height centered about the radially inwardmost of said contact planes; and said second inward taper begins at a point no more than two said contact heights radially outward of the radially inwardmost of said plurality of concentric contact planes.

22. The gas turbine engine of claim 19, wherein:

the radially inwardmost of said plurality of contact zones extends radially over an average contact height centered about the radially inwardmost of said contact planes; and said second inward taper begins at a point no more than one said contact heights radially outward of the radially inwardmost of said plurality of concentric contact planes.

23. The gas turbine engine of claim 19, wherein:

the radially inwardmost of said plurality of contact zones extends radially over an average contact height centered about the radially inwardmost of said contact planes; and said second inward taper begins at a point no more than one half of one said contact heights radially outward of the radially inwardmost of said plurality of concentric contact planes.

24. The gas turbine engine of claim 19, further comprising:

a second bulging region integral to and extending axially outward from said second radial face, said second bulging region having a second maximum axial excursion proximal the radially inwardmost of said plurality of concentric contact planes.

25. The gas turbine engine of claim 19, further comprising:

a second bulging region integral to and extending axially outward from said second radial face, said second bulging region having a second maximum axial excursion proximal the radially inwardmost of said plurality of concentric contact planes.

26. The gas turbine engine of claim 25, further comprising:

a third inward taper, said third inward taper comprising a region tapering axially inward with decreasing radial dimension from said second maximum axial excursion, said third inward taper beginning at a point radially outward of said live rim radius.

27. The gas turbine engine of claim 26, wherein:

the radially inwardmost of said plurality of contact zones extends radially over an average contact height centered about said radially inwardmost of said contact planes, and;

said third inward taper begins at a point no more than one said average contact height radially inward of said radially inwardmost of said plurality of contact planes.

28. The gas turbine engine of claim 26, wherein:

the radially inwardmost of said plurality of contact zones extends radially over an average contact height centered about said radially inwardmost of said plurality of concentric contact planes, and;

said third inward taper begins at a point no more than one half of one said average contact height radially inward of the radially inwardmost of said plurality of concentric contact planes.

29. The gas turbine engine of claim 26, further comprising:

a fourth inward taper, said fourth inward taper comprising a region tapering axially inward with increasing radial dimension from said second maximum axial excursion, said fourth inward taper beginning at a point radially inward of the radially outwardmost of said plurality of concentric contact planes.

30. The gas turbine engine of claim 29, wherein:

one of said plurality of concentric contact planes is immediately radially outward of the radially inwardmost of said plurality of concentric contact planes; and said fourth inward taper begins at a point radially inward of said contact plane.

31. The gas turbine engine of claim 29, wherein:

the radially inwardmost of said plurality of contact zones extends radially over an average contact height centered about the radially inwardmost of said contact planes; and said fourth inward taper begins at a point no more than two said contact heights radially outward of the radially inwardmost of plurality of concentric contact planes.

32. The gas turbine engine of claim 29, wherein:

the radially inwardmost of said plurality of contact zones extends radially over an average contact height centered about the radially inwardmost of said contact planes; and said fourth inward taper begins at a point no more than one said contact height radially outward of the radially inwardmost of plurality of concentric contact planes.

33. A gas turbine engine comprising:

a turbine disk comprising a hub having an axial bore, a web extending radially from said hub and terminating in a rim section extending radially outward from said web, said rim section having first and second radial faces defining a first axial thickness;

said rim section including a plurality of slots passing substantially axially from said first radial face to said second radial face defining a live rim radius of said disk, each of said plurality of slots defining a plurality of disk fillets adapted to engage a corresponding plurality of blade lobes along a corresponding plurality of contact zones, for retaining a plurality of turbine blades to said disk each of said plurality of contact zones being centered about a corresponding plurality of concentric contact planes;

said rim section further including a first bulging region integral to and extending axially outward from said first radial face, said first bulging region having a maximum axial excursion proximal to the radially inwardmost of said plurality of concentric contact planes; and a plurality of blades adapted to be disposed into an installed position in said plurality of slots, each of said plurality of blades including a blade shank having a third bulging region having a position with a radius with respect to a central axis and an angle with respect to a reference line that are the same as a radius with respect to a central axis and an angle with respect to a reference line of said first bulging region in said installed position.

34. A gas turbine engine comprising:

a turbine disk comprising a hub having an axial bore, a web extending radially from said hub and terminating in a rim section extending radially outward from said web, said rim section having first and second radial faces defining a first axial thickness;

said rim section including a plurality of slots passing substantially axially from said first radial face to said second radial face defining a live rim radius of said disk, each of said plurality of slots defining a plurality of disk fillets adapted to engage a corresponding plurality of blade lobes along a corresponding plurality of contact zones, for retaining a plurality of turbine blades to said disk, each of said plurality of contact zones being centered about a corresponding plurality of concentric contact planes;

said rim section further including a first bulging region integral to and extending axially outward from said first radial face, said first bulging region having a maximum axial excursion proximal to the radially inwardmost of said plurality of concentric contact planes;

a second bulging region integral to and extending axially outward from said second radial face, said second bulging region having a second maximum axial excursion proximal the radially inwardmost of said plurality of concentric contact planes; and a plurality of blades adapted to be disposed into an installed position in said plurality of slots, each of said plurality of blades including a blade shank having a third bulging region having a position with a radius with respect to a central axis and an angle with respect to a reference line that are the same as a radius with respect to a central axis and an angle with respect to a reference line of said first bulging region and a fourth bulging region having a position with a radius with respect to the central axis and an angle with respect to the reference line that are the same as a radius with respect to the central axis and an angle with respect to the reference line of said second bulging region in said installed position.

* * * * *